US009651344B1

(12) United States Patent
Chiu

(10) Patent No.: US 9,651,344 B1
(45) Date of Patent: May 16, 2017

(54) TARGET DEVICE FOR TOY GUN

(71) Applicant: Cheng Guo Enterprise Co., Ltd., Hsinchu (TW)

(72) Inventor: Chih-Wei Chiu, Hsinchu (TW)

(73) Assignee: Cheng Guo Enterprise Co., Ltd., Hsinchu (TW)

( * ) Notice: Subject to any disclaimer, the term of this patent is extended or adjusted under 35 U.S.C. 154(b) by 0 days.

(21) Appl. No.: 15/161,270

(22) Filed: May 22, 2016

(51) Int. Cl.

| | |
|---|---|
| ***F41J 5/04*** | (2006.01) |
| ***F41J 5/14*** | (2006.01) |
| ***F41J 1/00*** | (2006.01) |
| ***F41J 5/24*** | (2006.01) |
| *F41J 1/10* | (2006.01) |

(52) U.S. Cl.
CPC . *F41J 5/14* (2013.01); *F41J 1/00* (2013.01); *F41J 5/24* (2013.01); *F41J 1/10* (2013.01); *F41J 5/04* (2013.01)

(58) Field of Classification Search
CPC ..... F41J 1/10; F41J 13/02; F41J 5/04; F41J 5/052; F41J 5/14; A63B 63/00; A63B 2024/004; A63F 9/0204
USPC ..... 273/371–410
See application file for complete search history.

(56) References Cited

U.S. PATENT DOCUMENTS 2,691,526 A * 10/1954 Wesley ..... A63F 9/0204 273/359
3,319,960 A * 5/1967 Wilcox ..... F41J 5/00 273/404
3,561,762 A * 2/1971 Russell ..... A63F 7/0612 206/45.3
3,817,528 A * 6/1974 Stuhler ..... F41J 1/10 273/393
4,151,996 A * 5/1979 Lee ..... F41J 13/02 206/315.1
4,216,968 A * 8/1980 Yeeda ..... F41J 5/04 200/5 A
4,222,563 A * 9/1980 Heftler ..... A63B 24/0021 273/374
4,583,744 A * 4/1986 Tolliver ..... F41J 13/02 273/378
4,588,194 A * 5/1986 Steidle ..... F41J 7/04 273/391
5,280,919 A * 1/1994 Graham ..... F41J 1/01 273/381
5,560,617 A * 10/1996 Liang ..... F41J 5/14 273/371

(Continued)

*Primary Examiner* — Mark Graham
(74) *Attorney, Agent, or Firm* — Yuwen Guo

(57) ABSTRACT

A target device for toy gun comprises a control circuit board, an isolation net, a metal sensing board, a first buffering board, a display board, and a second buffering board. The control circuit board is arranged inside an upper cover of a box. The isolation net is arranged at a front side of the control circuit board. The metal sensing board is arranged at a front side of the isolation net and electrically connected with the control circuit board. The first buffering board is arranged at a front side of the metal sensing board. The display board is arranged at a front side of the first buffering board and electrically connected to the metal sensing board and the control circuit board. The display board may display scores, flash lights, make a sound, and display numeral indications. The second buffering board is arranged at a front side of the display board.

6 Claims, 4 Drawing Sheets

(56) References Cited

U.S. PATENT DOCUMENTS

| | | | | | |
|---|---|---|---|---|---|
| 5,829,753 | A * | 11/1998 | Wiser | F41J 1/10 | 273/407 |
| 6,089,571 | A * | 7/2000 | Cho | F41J 5/048 | 273/371 |
| 6,247,700 | B1 * | 6/2001 | Procupetz | F41J 1/01 | 273/348 |
| 6,554,284 | B2 * | 4/2003 | Chou | A63B 63/00 | 273/371 |
| 6,755,711 | B2 * | 6/2004 | McClung | A63B 67/00 | 273/398 |
| 7,163,204 | B1 * | 1/2007 | Liao | F41J 5/04 | 273/348.3 |
| 2005/0017456 | A1 * | 1/2005 | Shechter | F41J 5/14 | 273/371 |
| 2006/0006597 | A1 * | 1/2006 | Maeda | F41J 5/052 | 273/374 |
| 2009/0127790 | A1 * | 5/2009 | Chao | F41J 5/048 | 273/373 |
| 2009/0184474 | A1 * | 7/2009 | Chang | F41J 5/041 | 273/374 |
| 2010/0090407 | A1 * | 4/2010 | Lin | A63B 24/0021 | 273/371 |
| 2010/0259009 | A1 * | 10/2010 | Huang | F41J 3/00 | 273/374 |
| 2013/0187336 | A1 * | 7/2013 | Dreiband | F41J 13/02 | 273/410 |

* cited by examiner

TARGET DEVICE FOR TOY GUN

BACKGROUND OF THE INVENTION

1. Fields of the Invention

The present invention relates to a toy gun, and more particularly, to a target device for toy gun.

2. Descriptions of Related Art

The conventional toy guns, such as the BB guns, are welcomed for the users because the BB guns provide shooting actions which feel like real shooting and the BB guns can be played anyplace. The target for the BB guns is a netted member with a score sheet connected to the netted member so that the bullets can penetrate through the score sheet. The final scores can be collected by counting the numbers of the holes that the bullets penetrate the score sheet. The bullets are collected in the netted member. Nevertheless, the scores have to collected and counted manually, and it is difficult to judge how many bullets penetrate through the same hole(s).

Taiwan Published No. 174461 discloses an electronic target device which comprises a body, electronic members, detection board and remote controller. The detection board is composed of four layers of rubber sheets and the surface is printed as a desired target. The target comprises netted areas, ring areas and conductive areas. Each layer of the rubber sheet has the same size and wire distance made of way of printed circuits. The electronic members are composed of integrated circuits, ultra-sonic or infrared receivers, decoders, Light Emitting Diodes, and an audio IC. The sensor of the integrated circuits are connected with the detection board so that when the bullet hits the surface of the detection board, the impact is transferred into a signal which is passed to the integrated circuit, and the display device displays the scores by the number of bullets that hit the detection board. Also, the Light Emitting Diodes and the audio IC are activated.

However, the bullets are difficult to be collected after the games and the users have to collect the bullets from the floor. Besides, the target device is difficult to be carried.

The present invention intends to provide a target device which improves the shortcomings mentioned above.

SUMMARY OF THE INVENTION

The primary object of the present invention is to provide a target device for toy gun. The shooter of the toy gun may aim the target area (the divisions of the target ring or the bull eye) of the display board. When the bullet is shot to hit the second buffering board, besides the bullet may be dropped in the lower cover of the box, a pressure may be generated at a point which is hit on the second buffering board and then transmitted to metal sensing board so that the metal sensing board may be electrically connected to the control circuit board via the isolation net. The control circuit board may transmit the numeral which corresponds to the indicated/hit score to the scoring area of the display board. Simultaneously, the control circuit board may also control the two light display areas to flash or light in series and/or control the two loudspeaking areas to make a sound, such as music. Therefore, the light effects may be improved to make the shooting funner.

In order to achieve above object, the target device for toy gun comprises a control circuit board, arranged inside an upper cover of a box; an isolation net, arranged at a front side of the control circuit board; a metal sensing board, arranged at a front side of the isolation net and electrically connected with the control circuit board; a first buffering board, arranged at a front side of the metal sensing board; a display board, arranged at a front side of the first buffering board and electrically connected to the metal sensing board and the control circuit board, and the display board may display scores, flash lights, make a sound, and display numeral indications based on the scores; and a second buffering board, arranged at a front side of the display board.

In some embodiments, the first buffering board is made of TPR materials.

In some embodiments, the second buffering board is made of TPR materials.

In some embodiments, the display board includes a scoring area, a targeting area, two light display areas, and two loudspeaking areas, the scoring area is arranged above the targeting area, the two light display areas are respectively arranged at an upper-right end and an upper-left end of the targeting area, the two loudspeaking areas are respectively arranged a lower-right end and a lower-left end of the targeting area, the targeting area has a targeting ring and a bull eye, the targeting ring is surrounded the bull eye, and a plurality of scoring divisions is angularly spaced apart from one another and indicated different scores.

In some embodiments, each of the two light display areas is composed of at least one LED.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
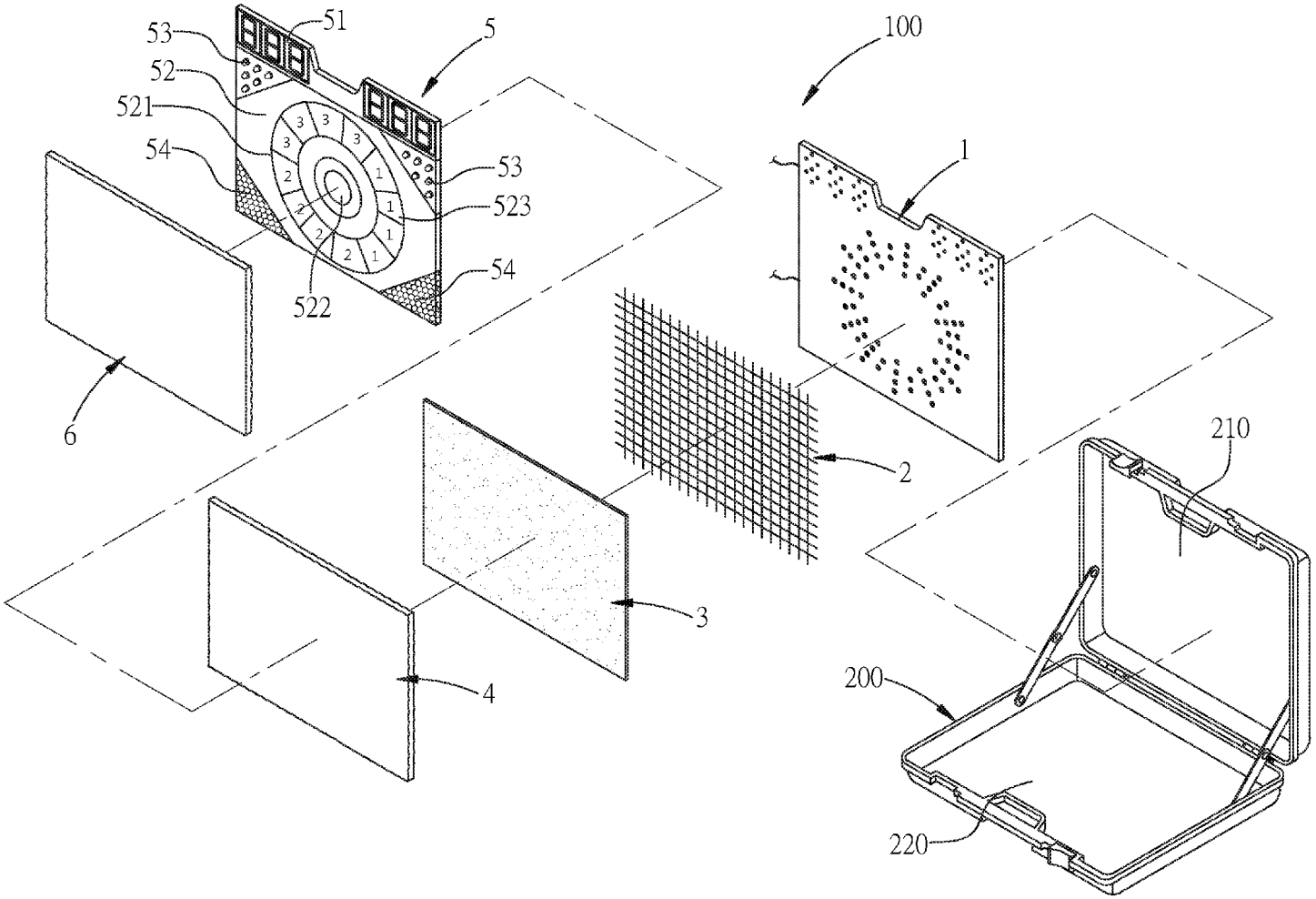
FIG. 1 is an exploded view of a target device for toy gun of the present invention.
Figure 2:
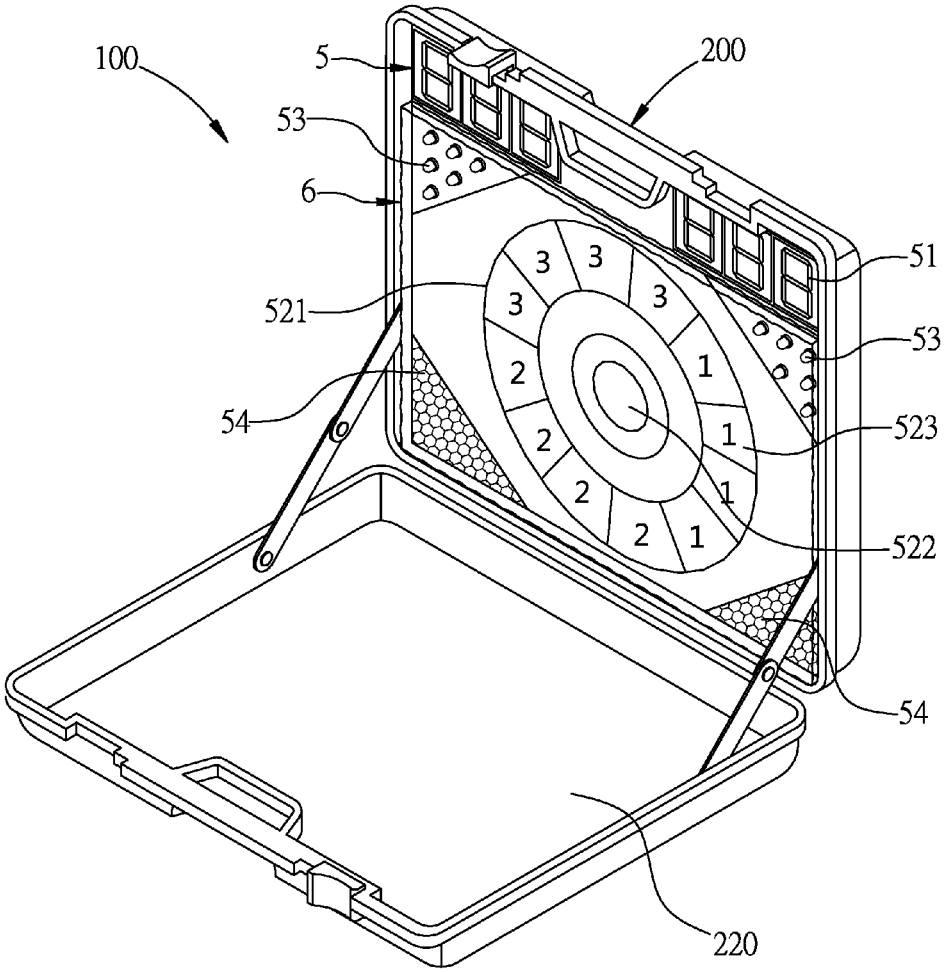
FIG. 2 is a perspective view of the target device of the present invention.
Figure 3:
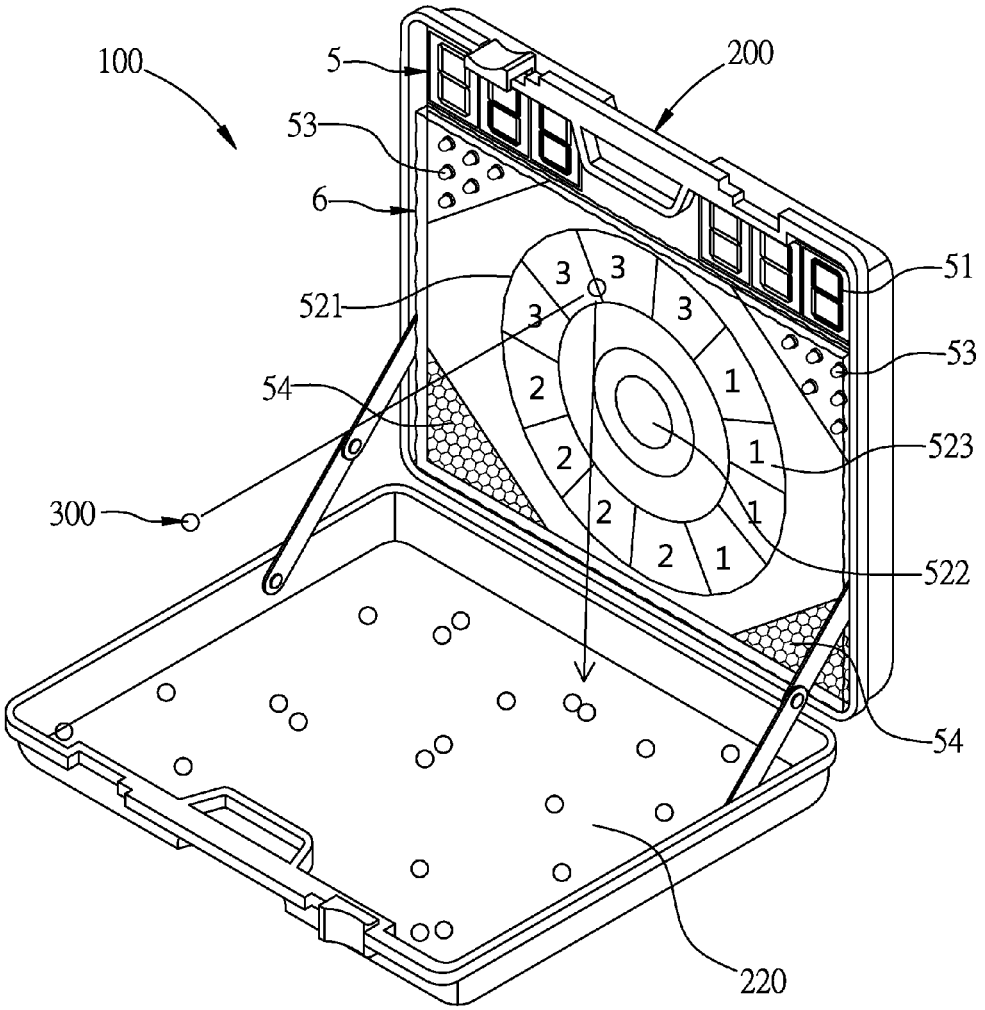
FIG. 3 is a perspective view of the target device of the present invention while the box is opened.
Figure 4:
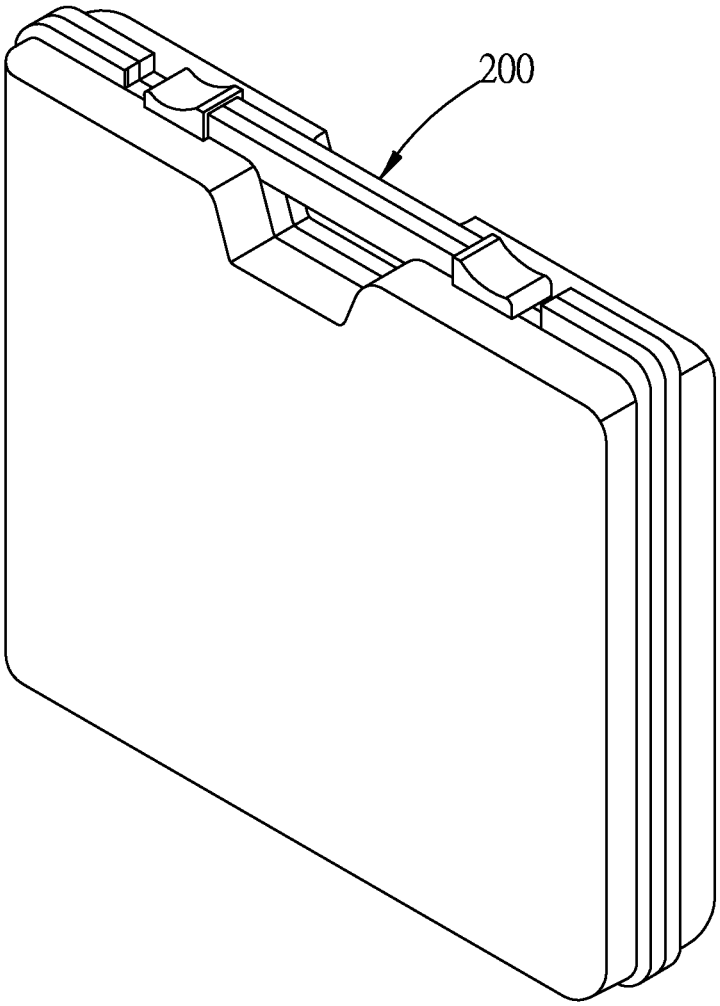
FIG. 4 is a perspective view of the target device of the present invention while the box is closed.

Please refer to FIGS. 1 to 4, the target device 100 for toy gun of the present invention comprises a control circuit board 1, an isolation net 2, a metal sensing board 3, a first buffering board 4, a display board 5, and a second buffering board 6.

The control circuit board 1 may be arranged inside an upper cover 210 of a box 200. The box 200 further has a lower cover 220. The lower cover 220 may be pivotably connected with the upper cover 210 so as to open and close the box 200.

The isolation net 2 may be arranged at a front side of the control circuit board 2.

The metal sensing board 3 may be arranged at a front side of the isolation net 2 and electrically connected with the control circuit board 1. The metal sensing board 3 is spaced apart from the control circuit board 1 and the isolation net 2 is interposed therebetween so as to prevent from becoming short circuit.

The first buffering board 4 may be arranged at a front side of the metal sensing board 3. The first buffering board 4 may be made of TPR (Thermo-Plastic-Rubber) materials, but not limited thereto.

The display board 5 may be arranged at a front side of the first buffering board 4 and electrically connected to the metal sensing board 3 and the control circuit board 1. The display board 5 may display scores, flash lights, make a sound, and display numeral indications based on the scores. That is, the display board 5 may include a scoring area 51, a targeting area 52, two light display areas 53, and two loudspeaking areas 54. The scoring area 51 may be arranged above the targeting area 52 for showing the scores. The two light display areas 53 are respectively arranged at an upper-right end and an upper-left end of the targeting area 52. Each of the two light display areas 53 may be composed of at least one LED (light emitting diode), but not limited thereto. The two loudspeaking areas 54 are respectively arranged a lower-right end and a lower-left end of the targeting area 52. The targeting area 2 may have a targeting ring 521 and a bull eye 522. The targeting ring 521 is surrounded the bull eye 52. A plurality of scoring divisions 523 may be angularly spaced apart from one another and indicated different scores for providing the shooter to aim the target (bull eye 522).

The second buffering board 6 may be arranged at a front side of the display board 5. The second buffering board 6 may be made of TPR materials, but not limited thereto.

According to above mentioned structure, the shooter of the toy gun may aim the target area 52 (the divisions 523 of the target ring 521 or the bull eye 522) of the display board 5. When the bullet 300 is shot to hit the second buffering board 6, besides the bullet 400 may be dropped in the lower cover 220 of the box 200, a pressure may be generated at a point which is hit on the second buffering board 6 and then transmitted to metal sensing board 3 so that the metal sensing board 3 may be electrically connected to the control circuit board 1 via the isolation net 2. The control circuit board 1 may transmit the numeral which corresponds to the indicated/hit score to the scoring area 51 of the display board 5. Simultaneously, the control circuit board 1 may also control the two light display areas 53 to flash or light in series and/or control the two loudspeaking areas 54 to make a sound, such as music. Therefore, the light effects may be improved to make the shooting funner.

While we have shown and described the embodiment in accordance with the present invention, it should be clear to those skilled in the art that further embodiments may be made without departing from the scope of the present invention.

What is claimed is:

1. A target device for toy gun, comprising:

a control circuit board, arranged inside an upper cover of a box;

an isolation net, arranged at a front side of the control circuit board;

a metal sensing board, arranged at a front side of the isolation net and electrically connected with the control circuit board;

a first buffering board, arranged at a front side of the metal sensing board;

a display board, arranged at a front side of the first buffering board and electrically connected to the metal sensing board and the control circuit board, and the display board may display scores, flash lights, make a sound, and display numeral indications based on the scores; and a second buffering board, arranged at a front side of the display board.

2. The target device as claimed in claim 1, wherein the first buffering board is made of TPR materials.

3. The target device as claimed in claim 1, wherein the second buffering board is made of TPR materials.

4. The target device as claimed in claim 2, wherein the second buffering board is made of TPR materials.

5. The target device as claimed in claim 1, wherein the display board includes a scoring area, a targeting area, two light display areas, and two loudspeaking areas, the scoring area is arranged above the targeting area, the two light display areas are respectively arranged at an upper-right end and an upper-left end of the targeting area, the two loudspeaking areas are respectively arranged a lower-right end and a lower-left end of the targeting area, the targeting area has a targeting ring and a bull eye, the targeting ring surrounds the bull eye, and a plurality of scoring divisions are angularly spaced apart from one another and indicated different scores.

6. The target device as claimed in claim 5, wherein each of the two light display areas is composed of at least one LED.

* * * * *